US006568480B2

(12) United States Patent
Dewey

(10) Patent No.: US 6,568,480 B2
(45) Date of Patent: May 27, 2003

(54) ORIENTATION AND LOCATOR SYSTEM AND METHOD OF USE

(75) Inventor: Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/848,646

(22) Filed: May 3, 2001

(65) Prior Publication Data

US 2002/0162656 A1 Nov. 7, 2002

(51) Int. Cl.[7] ..... E21B 23/00

(52) U.S. Cl. ..... 166/382; 166/381; 166/117.6; 166/117.5

(58) Field of Search ..... 166/117.6, 117.5, 166/50, 381, 382, 255.3

(56) References Cited

U.S. PATENT DOCUMENTS

| | | | | | |
|---|---|---|---|---|---|
| 3,610,336 | A | * | 10/1971 | Sizer | 166/117.6 |
| 4,094,360 | A | * | 6/1978 | Nelson | 166/117.5 |
| 4,121,657 | A | * | 10/1978 | McClure | 166/66 |
| 4,285,399 | A | | 8/1981 | Holland et al. | 166/113 |
| 4,304,299 | A | | 12/1981 | Holland et al. | 166/255 |
| 4,397,355 | A | | 8/1983 | McLamore | 166/297 |
| 4,440,222 | A | * | 4/1984 | Pullin | 166/117.5 |
| 4,807,704 | A | | 2/1989 | Hsu et al. | 166/313 |
| 5,154,231 | A | | 10/1992 | Bailey et al. | 166/298 |
| 5,409,060 | A | * | 4/1995 | Carter | 166/117.5 |
| 5,467,819 | A | | 11/1995 | Braddick | 166/117.6 |
| 5,579,829 | A | * | 12/1996 | Comeau et al. | 166/117.6 |
| 5,592,991 | A | | 1/1997 | Lembcke et al. | 166/298 |
| 5,771,972 | A | | 6/1998 | Dewey et al. | 166/298 |
| 5,778,980 | A | * | 7/1998 | Comeau et al. | 166/117.6 |
| 5,862,859 | A | * | 1/1999 | Speed et al. | 166/117.5 |
| 5,871,046 | A | | 2/1999 | Robison | 166/241.1 |
| 5,894,889 | A | | 4/1999 | Dewey et al. | 166/298 |
| 6,244,340 | B1 | | 6/2001 | McGlothen et al. | 166/255.3 |
| 6,283,208 | B1 | * | 9/2001 | George et al. | 166/117.6 |
| 6,305,474 | B1 | * | 10/2001 | Roberts et al. | 166/117.6 |
| 2002/0066577 | A1 | * | 6/2002 | Dewey et al. | 166/382 |

FOREIGN PATENT DOCUMENTS

| | | | |
|---|---|---|---|
| EP | 0834 643 A2 | 8/1998 | E21B/23/02 |
| GB | 2 351 303 | 12/2000 | E21B/23/00 |

OTHER PUBLICATIONS

Smith Services; Completion Systems; *Millennium Whipstock Packer*; (undated) No. SS–LN–1006; (1 p.).

British Search Report for Application No. GB 0210136.8 dated Sep. 4, 2002; (pp. 2).

* cited by examiner

*Primary Examiner*—Thomas B. Will
*Assistant Examiner*—Thomas Bomar
(74) *Attorney, Agent, or Firm*—Conley Rose, P.C.

(57) ABSTRACT

An orientation and locator system including a receiver sub disposed in and installed with a casing string in the borehole. The receiver sub has azimuth and depth profiles for positively locating a predetermined position within the borehole. The profiles are within the inside diameter of the casing string and do not restrict the flowbore of the casing. The orientation and locator system further includes a coupling sub attached to a well tool and adapted to engage the receiver sub to orient and locate the well tool within the borehole for conducting a well operation. The coupling sub has an alignment key and a plurality of dogs for engaging the azimuth and depth profiles, respectively. Further, the coupling sub may pass completely through the receiver sub en route to another receiver sub located in the casing string further downhole. The coupling sub and receiver sub are configured such that they may be engaged whether the coupling sub is passing upstream or downstream through the casing string.

44 Claims, 9 Drawing Sheets

ORIENTATION AND LOCATOR SYSTEM AND METHOD OF USE

CROSS-REFERENCE TO RELATED APPLICATIONS

Not applicable

BACKGROUND OF THE INVENTION

1. Field of the Invention

The present invention generally relates to an orientation and locator system including a coupling sub to secure a tool within a receiver sub previously disposed within a string of casing installed in the borehole and more particularly, to a coupling sub that is installed and removed from the receiver sub in the casing string. Furthermore, the present invention relates to, a coupling sub for securing, positioning, and removing a whipstock at a known location within in a cased borehole.

2. Description of the Related Art

It is common for well operations to be conducted at a known location within the bore of a well. This location may be relative to a formation, to a previously drilled well bore, or to a previously conducted well operation. For example, it is important to know the depth of a previous well operation. However, measurements from the surface are often imprecise. Although it is typical to count the sections of pipe in the pipe string as they are run into the borehole to determine the depth of a well tool mounted on the end of the pipe string, the length of the pipe string may vary due to stretch under its own weight or due to downhole temperatures. This variance is magnified when the pipe string is increased in length, such as several thousand feet. It is not uncommon for the well tool to be off by several feet when depth is measured from the surface.

Many well operations require locating a particular depth and azimuth in the borehole for conducting a new well operation. One such well operation is the drilling of one or more lateral boreholes. One typical sidetracking operation for drilling a lateral wellbore from a new or existing wellbore includes running a packer or anchor into the wellbore on wireline or on coiled tubing and then setting the packer or anchor within the wellbore. The packer or anchor is set at a known depth in the well by determining the length of the wireline or coiled tubing run into the wellbore. A second run or trip is made into the wellbore to determine the orientation of the packer or anchor. Once this orientation is known, a latch and whipstock are properly oriented and run into the wellbore during a third trip wherein the latch and whipstock are seated on the packer or anchor. One or more mills are then run into the wellbore on a drill string to mill a window in the casing of the wellbore. The whipstock is then retrieved. Subsequent trips into the wellbore may then be made to drill the lateral borehole or to install a deflector or other equipment for down hole operations.

In conventional sidetracking operations, although the depth of the packer or anchor used to support the whipstock is known, the orientation of the packer or anchor within the wellbore may not be known. Thus, a subsequent trip must be made into the wellbore to determine the orientation of the packer or anchor using an orientation tool. The packer or anchor has a receptacle with an upwardly facing orienting surface which engages and orients the orientation tool stabbed into the packer or anchor. The orientation tool then determines the orientation of the packer or anchor within the wellbore. Once the orientation of the packer or anchor has been established, the orientation of the latch, whipstock and mill to be subsequently disposed in the wellbore is then adjusted at the surface so as to be properly oriented when run into the wellbore. The latch, whipstock and mill are then run into the wellbore and stabbed and latched into the packer or anchor such that the face of the whipstock is properly directed for milling the window and drilling the lateral borehole.

Since the packer or anchor are not oriented prior to their being set, the receptacle having the orienting surface and a mating connector may have an orientation that could lead to the receptacle being damaged during future operations. If the receptacle is damaged, it will not be possible to use it for orientation and latching of a subsequent well operation.

It is preferred to avoid numerous trips into the wellbore for the sidetracking operation. A one trip milling system is disclosed in U.S. Pat. Nos. 5,771,972 and 5,894,889. See also, U.S. Pat. No. 4,397,355.

In a sidetracking operation, the packer or anchor serves as a downhole well tool which anchors the whipstock within the cased borehole against the compression, tension, and torque caused by the milling of the window and the drilling of the lateral borehole. The packer and anchor have slips and cones which expand outward to bite into the cased borehole wall to anchor the whipstock. A packer also includes packing elements which are compressed during the setting operation to expand outwardly into engagement with the casing thereby sealing the annulus between the packer and the casing. The packer is used for zone isolation so as to isolate the production below the packer from the lateral borehole.

An anchor without a packing element is typically used where the formation in the primary wellbore and the formation in the lateral wellbore have substantially the same pressure and thus the productions can be commingled since there is no zone pressure differentiation because the lower zone has substantially the same formation pressure as that being drilled for the lateral. In the following description, it should be appreciated that a packer includes the anchoring functions of an anchor.

The packer may be a retrievable packer or a permanent big bore packer. A retrievable packer is retrievable and closes off the wellbore while a permanent big bore packer has an inner mandrel forming a flowbore through the packer allowing access to that portion of the wellbore below the packer. The mandrel of the big bore packer also serves as a seal bore for sealing engagement with another well tool, such as a whipstock, bridge plug, production tubing, or liner hanger. The retrievable packer includes its own setting mechanism and is more robust than a permanent big bore packer because its components may be sized to include the entire wellbore since the retrievable anchor and packer does not have a bore through it and need not be a thin walled member.

One apparatus and method for determining and setting the proper orientation and depth in a wellbore is described in U.S. Pat. No. 5,871,046. A whipstock anchor is run with the casing string to the desired depth as the well is drilled and the casing string is cemented into the new wellbore. A tool string is run into the wellbore to determine the orientation of the whipstock anchor. A whipstock stinger is oriented and disposed on the whipstock at the surface, and then the assembly is lowered and secured to the whipstock anchor. The whipstock stinger has an orienting lug which engages an orienting groove on the whipstock anchor. The whipstock stinger is thereby oriented on the whipstock anchor to cause the face of the whipstock to be positioned in the desired direction for drilling. The whipstock stinger may be in two parts allowing the upper part to be rotated for orientation in the wellbore. The anchor portion of the apparatus of the '046 patent is structured such that it restricts the flowbore of the casing string. Furthermore, because of this restriction, if subsequent anchors are to be set beyond a primary anchor, they must accommodate progressively smaller gauges. There is no provision in the '046 patent to allow a latching tool engage one anchor, and then pass through en route to engagement with another anchor further downhole.

U.S. Pat. No. 5,467,819 describes an apparatus and method which includes securing an anchor in a cased wellbore. The anchor may include a big bore packer. The wall of a big bore packer is roughly the same as that of a liner hanger. The anchor has a tubular body with a bore therethrough and slips for securing the anchor to the casing. The anchor is set by a releasable setting tool. After the anchor is set, the setting tool is retrieved. A survey tool is oriented and mounted on a latch to run a survey and determine the orientation of the anchor. A mill, whipstock, coupling and a latch or mandrel with orientation sleeve connected to the lower end of the whipstock are assembled with the coupling allowing the whipstock to be properly oriented on the orientation sleeve. The assembly is then lowered into the wellbore with a lug on the orientation sleeve engaging an inclined surface on the anchor to orient the assembly within the wellbore. The window is milled and then the lateral is drilled. If it is desirable to drill another lateral borehole, the whipstock may be reoriented at the surface using the coupling and the assembly lowered into the wellbore and re-engaged with the anchor for drilling another lateral borehole.

U.S. Pat. No. 5,592,991 discloses another apparatus and method for installing a whipstock. A permanent big bore packer having an inner seal bore mandrel and a releasable setting tool for the packer allows the setting tool to be retrieved to avoid potential leak paths through the setting mechanism after tubing is later sealingly mounted in the packer. An assembly of the packer, releasable setting tool, whipstock, and one or more mills is lowered into the existing wellbore. The packer may be located above or below the removable setting tool. A survey tool may be run with the assembly for proper orientation of the whipstock. A lug and orienting surface are provided with the packer for orienting a subsequent well tool. The packer is then set and the window in the casing is milled. The whipstock and setting tool are then retrieved together leaving the big bore packer with the seal bore for sealingly receiving a tubing string so that production can be obtained below the packer. One disadvantage of the big bore packer is that its bore size will not allow the next conventional smaller sized casing to be run through its bore requiring an even smaller sized casing.

Furthermore, U.S. Pat. No. 5,592,991 describes the use of a big bore packer as a reference device. However, once the releasable setting tool and whipstock are removed from the big bore packer, the packer no longer has sealing integrity. The big bore packer only seals the wellbore after another assembly is lowered into the well and a stinger is received by the big bore packer to create or establish sealing integrity. The big bore packer does double duty, first it serves as the anchor for the milling operation and then it becomes a permanent packer for the completion.

In both the '819 and '991 patents, the whipstock assembly must latch into the packer or anchor to anchor the whipstock and withstand the compression, tension, and torque applied during the milling of the window and the drilling of the lateral borehole. Further, the use of a big bore packer requires a packer assembly which can withstand a 5,000 psi pressure differential and thus all of its components must have a minimum 5,000 psi burst and collapse capability.

The big bore packer has the additional disadvantage of having a mandrel extending through it and on which is mounted the cones for activating the slips of the packer. The mandrel is subsequently used as a seal bore which is then used for sealing with a tubing string. This mandrel is not only an additional mechanical part but requires a reduction in the diameter of the bore of the packer. Furthermore, to remove restrictions from the borehole following operations, an additional trip downhole to retrieve the anchor or packer is required.

When sidetracking operations are conducted using systems of the '819 and '991 patents, numerous trips are required into the wellbore. A packer is first run into the wellbore on wireline or on coiled tubing and then is set within the wellbore. A second run or trip is made into the wellbore to determine the orientation of the packer. Once this orientation is known, a latch and whipstock are properly oriented and run into the wellbore during a third trip wherein the latch and whipstock are seated on the packer. At this point, a window is milled in the casing of the wellbore. The whipstock is then retrieved. Subsequent trips into the wellbore are then made to install a deflector or other equipment to drill a rat hole to initiate the drilling of the lateral borehole.

Further, in conventional sidetracking operations, the packer or anchor, used to support the whipstock, are run and set in the wellbore without knowing their orientation within the wellbore. Thus, a subsequent trip must be made into the wellbore to determine the orientation of the packer or anchor using an orientation member. The packer or anchor has a receptacle with an upwardly facing mule shoe orienting surface to orient a subsequent apparatus stabbed into the packer or anchor. Once the orientation of the packer or anchor has been established, a latch, whipstock and mill can be run into the wellbore and stabbed and latched into the packer or anchor.

Since the packer or anchor is not oriented prior to being set, the receptacle, having the mule shoe orienting surface and a mating connector, may have an orientation that could lead to the receptacle being damaged during future operations. If the receptacle is damaged too badly, then it will not be possible thereafter to use it for orientation and latching of additional well tools.

A well orientation and depth location device is disclosed in U.S. patent application Ser. No. 09/575,091 filed May 19, 2000 and entitled Anchor Apparatus and Method, which corresponds to UK Patent Application GB 2 351 303, published Dec. 27, 2000, hereby incorporated herein by reference. The '091 application discloses a well location anchor that is deployed upon a tool string and is set at a desired depth and azimuth to properly locate any well operations that may subsequently occur. The anchor includes an integral means to resist any axial or rotational loads that may be transmitted to it during any operations that may utilize the anchor's location capabilities. Because the anchor is run following drilling and casing operations, it is set within the existing borehole or casing string and restricts the movement of large gage tools or drillstring therethrough. Because of this, the anchor locator of the '091 application significantly limits further exploration and production of wells in which it is used.

The present invention overcomes the deficiencies of the prior art.

BRIEF SUMMARY OF THE INVENTION

An orientation and locator system including a receiver sub disposed in and installed with a casing string in the borehole. The receiver sub has azimuth and depth profiles for positively locating a predetermined position within the borehole. The profiles are within the inside diameter of the casing string and do not restrict the flowbore of the casing. The orientation and locator system further includes a coupling sub attached to a well tool and adapted to engage the casing receiver sub to orient and locate the well tool within the borehole for conducting a well operation. The coupling sub has an alignment key and a plurality of dogs for engaging the azimuth and depth profiles, respectively. Further, the coupling sub may pass completely through the receiver sub en route to another receiver sub located in the casing string further downhole. The coupling sub and receiver sub are configured such that they may be engaged whether the coupling sub is passing upstream or downstream through the casing string.

The present invention overcomes the deficiencies of the prior art by providing a location system incorporating a receiver sub that is disposed upon and installed with the casing string. Other objects and advantages of the invention will appear from the following description.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1A:
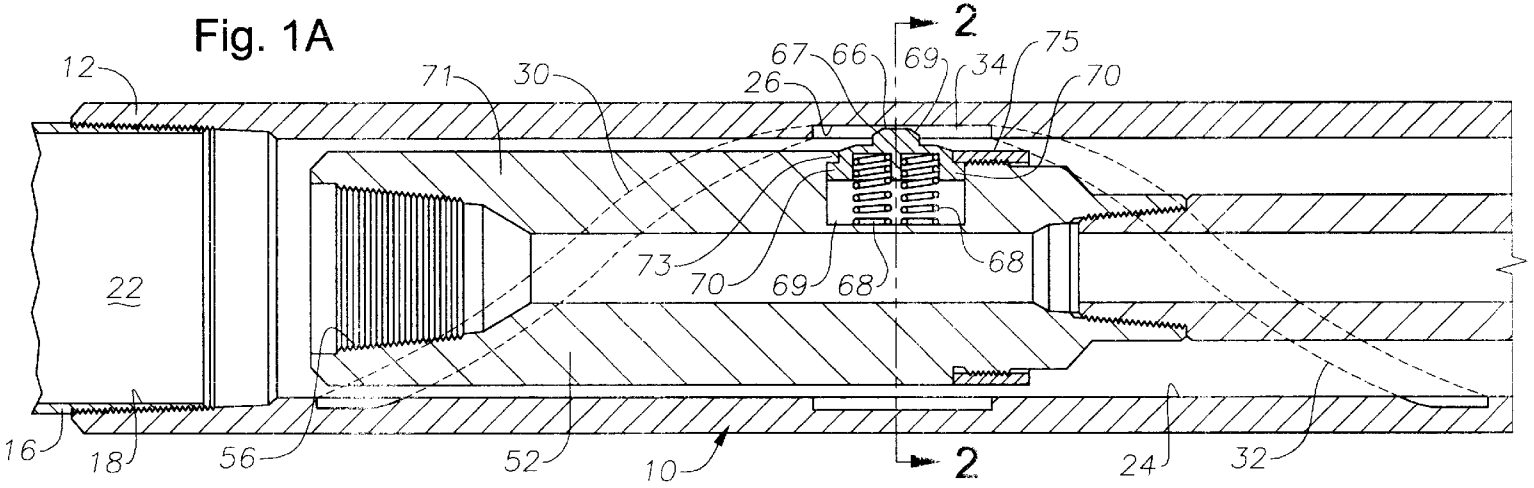
FIGS. 1A–B are a sectioned side view of a coupling sub and a corresponding receiver sub in accordance with a preferred embodiment of the present invention in the engaged position.
Figure 1B:
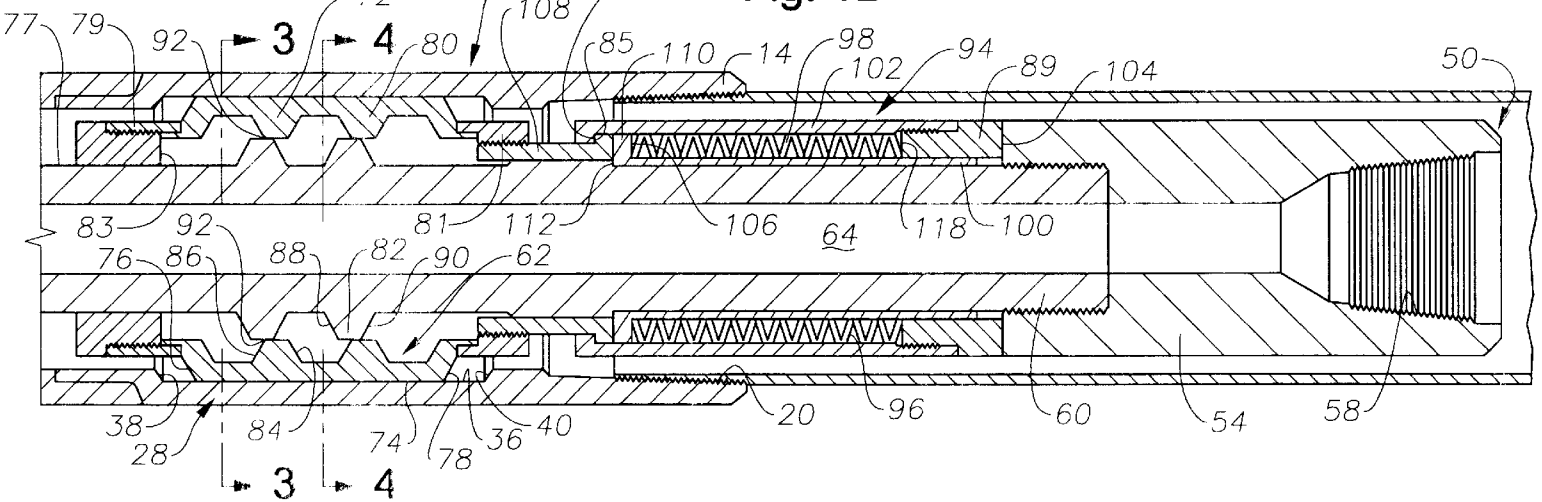

Referring initially to FIGS. 1A and 1B, an orientation and locator system 11 is shown for a casing string 16. The orientation and locator system 11 includes a coupling or receiver sub 10 and a coupling sub 50. Receiver sub 10 has female ends 12, 14 threadingly disposed in casing string 16. Casing string 16 is connected to each end 12,14 of receiver sub 10 by male rotary threaded connections 18, 20 and has a flowbore 22 therethrough. Receiver sub 10 includes a primary inner bore 24, an interior azimuth profile 26, and a depth location profile 28. Azimuth profile 26 includes upper and lower muleshoes 30, 32 that meet at a central key slot 34. Profile 28 is preferably an annular groove cut within the inner bore 24 of receiver sub 10 so as to not restrict flow therethrough or project into the flowbore 22 of casing string 16. Depth location profile 28, includes a location bore 36 and upper and lower annular chamfered shoulders 38, and 40.

The double muleshoe 30, 32 of receiver sub 10 allows coupling sub 50 to be oriented either as it is being lowered downwardly through receiver sub 10 or being pulled upwardly from below and through sub 10. It should be appreciated that a double muleshoe is not required. In fact, in one embodiment, upper muleshoe 30 is eliminated to shorten the length of receiver sub 10. In that embodiment, the coupling sub 50 passes through casing receiver sub 10 and then is pulled back up so as to latch into lower muleshoe 32 to orient coupling sub 50.

Receiver sub 10 with locator profiles 26 and 28 is installed in the well bore as a part of casing string 16 following borehole drilling. Because casing string 16 is typically cemented within the borehole, receiver subs 10 in accordance with the present invention are deployed almost exclusively in new wells as they must be installed with casing string 16. Inner bore 24 of receiver sub 10 is preferred to be the same size and configuration as flowbore 22 of casing string 16. Receiver sub 10 preferably has a larger wall thickness than the remainder of casing string 16 to allow profile 26 to be machined within bore 24 without penetrating completely through the wall of receiver sub 10.

Coupling sub 50 includes upper and lower sections 52, 54, each configured to have an end connected to a work string (not shown) by threaded rotary "box" connections 56 and 58, respectively. Threadably disposed between upper and lower sections 52, 54 is a latch mandrel 60 upon which a latch system 62 is disposed. A flowbore 64 extends from upper section 52, through mandrel 60, and to lower section 54 of coupling sub 50. It is preferred that flowbore 64 approximate the through bore of required for the passage of well tools (not shown) within the work string so that flow therethrough is not restricted.

Figure 2:
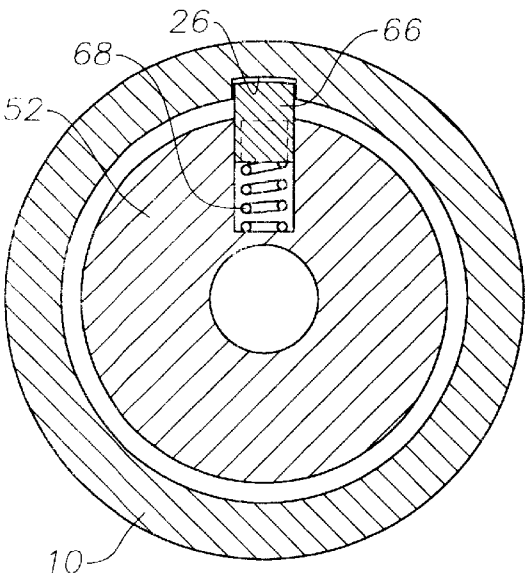
FIG. 2 is a cross-sectional view of the key of FIG. 1A in an extended position.

Referring now to FIGS. 1A–B and 2, upper section 52 of coupling sub 50 includes a key 66 adapted to ride within azimuth profile 26 so as to properly angularly orient coupling sub 50 within receiver sub 10. FIG. 2 shows a cross sectional top view of key 66 extending from the upper section 52 of coupling sub 50 into receiver sub 10. As shown in FIGS. 1A–B, key 66 is preferably spring biased outwardly by springs 68 and is retained within a recess 65 in the wall 71 of upper section 52 by retainer flanges 70 which engage tangs 73, 75 to prevent key 66 from moving out of the recess 65 cut within upper section 52. Tang 75 includes a member releasably fastened to upper section 52 for assembly purposes. Key 66 includes upstream and downstream tapered surfaces 67, 69 respectively, to facilitate engagement and disengagement with profile 26. Key 66 acts within the channels formed by muleshoes 30, 32 to apply an angular moment to coupling sub 50 and orient it to the desired azimuth as defined by profile 26. When removal is desired, an upward or downward force is applied to coupling sub 50 and taper ends 67, 69, depending on direction, cams key 66 into upper section 52 against the bias of spring 68. With key 66 compressed within recess 65 of upper section 52, the angular orientation of coupling 50 is no longer restricted.

Figure 4:
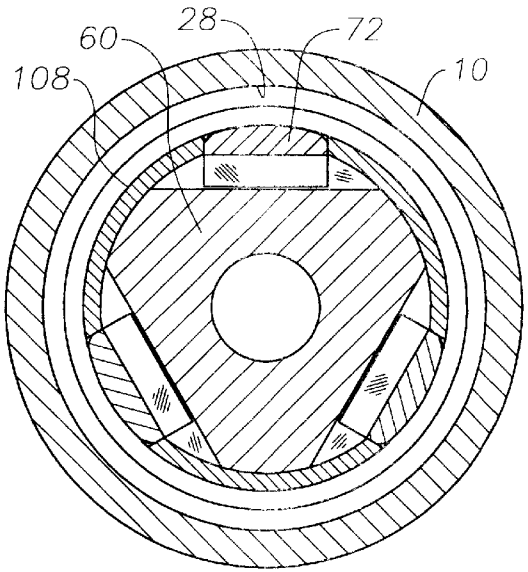
FIG. 4 is a cross-sectional view of the dogs of FIG. 1B in a retracted position.
Figure 3:
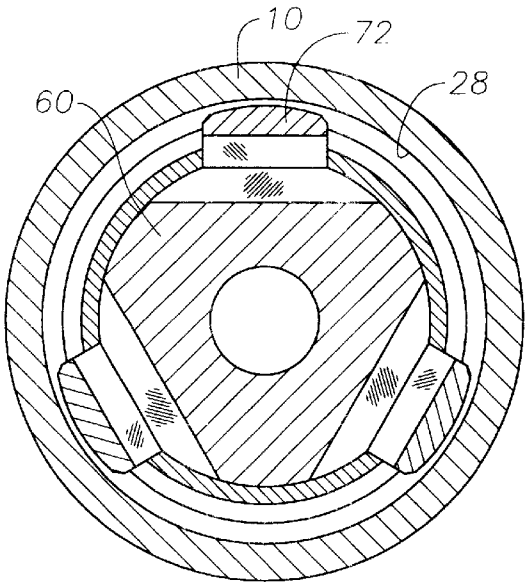
FIG. 3 is a cross-sectional view of the dogs of FIG. 1B in an extended position.

Referring now to FIGS. 1A–B, 3 and 4, because azimuth profile 26 is provided to locate sub 50 to the proper azimuth with respect to receiver sub 10, profile 26 must allow a slight amount of lateral movement between subs 10, 50. Depth location profile 28 acts in conjunction with azimuth profile 26. Latch system 62 is preferably located on mandrel 60 below alignment key 66 and includes a plurality of dogs 72, preferably three, each disposed in a window 83 in a sleeve 108 disposed on the exterior surface 77 of mandrel 60. Dogs 72 are retained in windows 83 by retainers 79, 81. Retainers 79, 81 are releasably attached to sleeve 108. Dogs 72 are configured to engage depth location profile 28 in receiver sub 10 when coupling sub 50 is at the proper depth. When actuated, dogs 72 expand outward radially into annular depth location profile 28 to secure sub 50 within receiver sub 10. FIGS. 3 and 4 show cross-sectional details of an array of dogs 72 with FIG. 3 showing the dogs 72 in the expanded position and FIG. 4 showing the dogs 72 in the contracted position.

As best shown in FIGS. 1A–B, dogs 72 include an engagement surface 74, upper and lower wedge profiles 76, 78, and at least one inwardly projecting arcuate member 80. Inwardly projecting members 80 of dogs 72 are configured to ride up on corresponding outwardly projecting annular members 82 of mandrel 60. Camming surfaces 84, 86 of members 80 coact with corresponding camming surfaces 88, 90 of members 82 to drive dogs 72 into engagement with profile 28. When dogs 72 are fully extended, as shown in FIGS. 1A–B, members 80 and 82 meet at surfaces 92 to secure dogs 72 in their extended and locked position A carriage assembly 94 is mounted on the lower end of sleeve 108 by interlocking shoulders 85, 87. An annular chamber 98 is formed by an inner sleeve 100 having a downwardly facing annular shoulder 106 and an outer sleeve 102 having a retainer member 89 forming an upwardly facing annular shoulder 118 to house Belleville springs 96 comprising a stack of Belleville washers. Retainer member 89 also includes a downwardly facing shoulder 104 which engages the upper end of lower section 54. If sleeve 108 with dogs 72 moves upwardly, shoulder 87 of outer sleeve 102 engaging shoulder 85 on sleeve 108 causes outer sleeve 102 and retainer member 89 to move upwardly whereby upwardly facing shoulder 118 compresses springs 96 against downwardly facing shoulder 106. If sleeve 108 with dogs 72 moves downwardly, then the lower end 112 of sleeve 108 engages the upper end 110 of inner sleeve 100 causing downwardly facing shoulder 106 to move downwardly to compress springs 96 against shoulder 118. Thus, carriage 94 and belleville stack 96 are constructed to bias dogs 72 against movement either upstream or downstream from an equilibrium point.

In FIGS. 1A–B Belleville spring washers 96 are shown at their most relaxed, or de-energized, state. Spring stack 96 is preferably configured to be slightly compressed in this configuration so that axial play in the carriage 94 is minimized, with shoulder 104 engaging lower section 54 and shoulders 110, 112 engaging thereby preventing stack 96 of washers from slackening. Furthermore, having spring stack 96 energized in it's base state, requires a relatively higher load to be applied to carriage 94 before displacement up or down the axis of the borehole is possible. Belleville stack 96 can exert as much as 20,000 pounds per square inch of pressure upon the carriage 94 and engaged sleeve 108 with dogs 72. This amount of elevated spring energy enables the latching action of coupling sub 50 to be much more controlled and predictable than with other systems. Furthermore, a high energy latch has a much greater chance of being "felt," or noticed, by the operator during engagement than a lower energy counterpart.

Figure 5A:
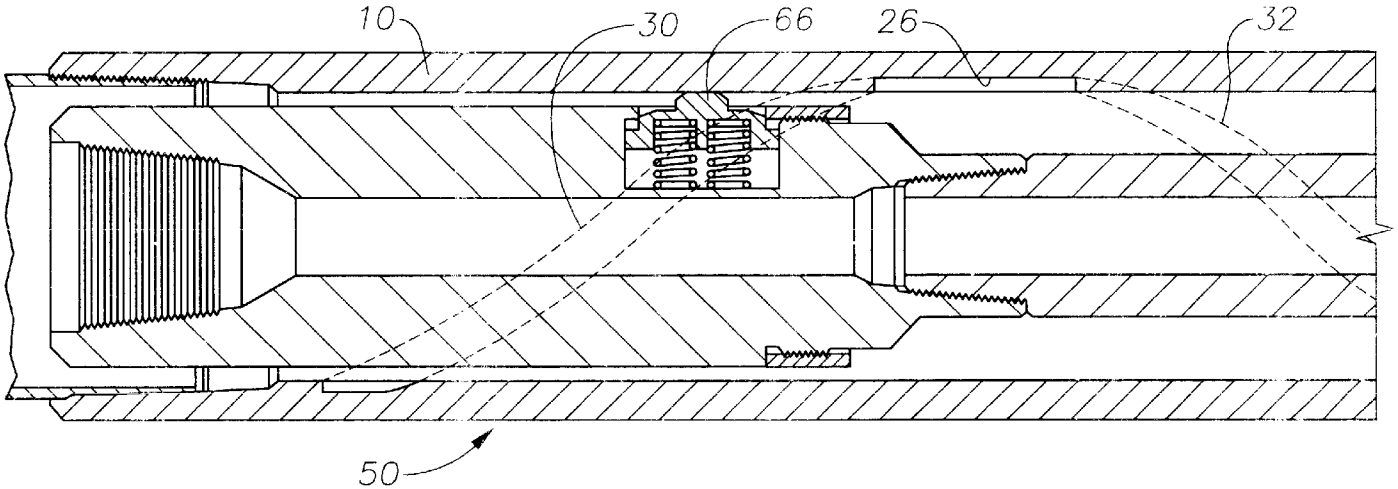
FIGS. 5A–B are a sectioned side view of the coupling sub and corresponding receiver sub of FIG. 1A–B prior to engagement.
Figure 5B:
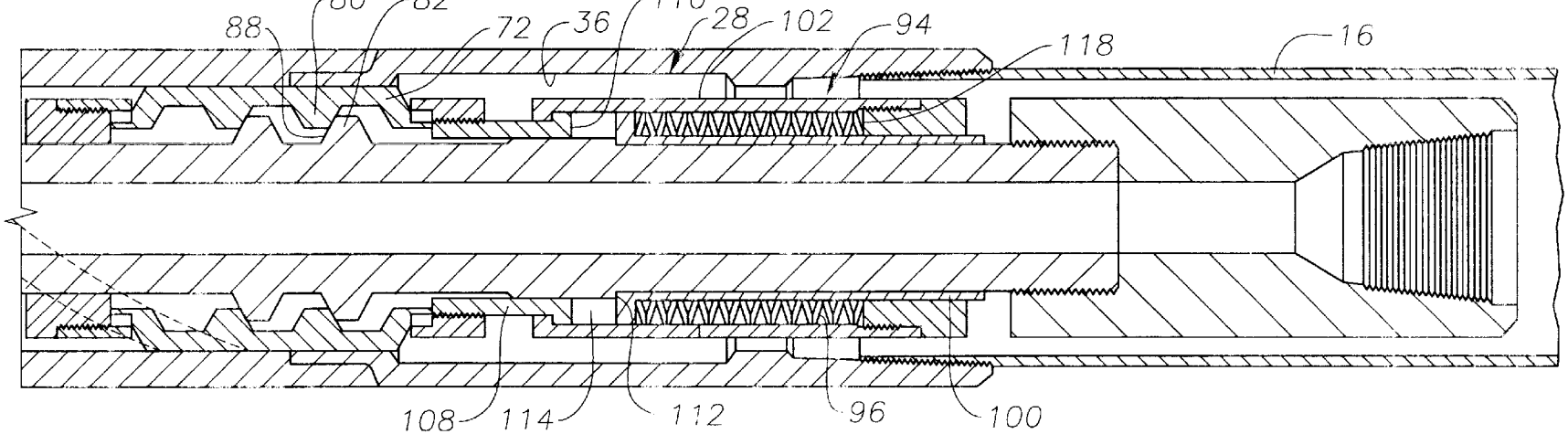

Referring now to FIGS. 5A–B, the coupling sub 50 is shown during a trip into casing string 16 extending into the borehole and prior to engagement with receiver sub 10. While tripping in, projecting members 80 of dogs 72 are upstream of the projecting members 82 on mandrel 60. As shown, sleeve 108 with dogs 72 is "dragged" rather than "pushed" by mandrel 60 and carriage 94 while sub 50 is tripped into casing string 16. This configuration allows the free movement of coupling sub 50 within casing string 16 without the worry that dogs 72 will snag an obstruction that will stop or restrict movement of coupling sub 50. A clearance gap 114 is created between shoulders 110, 112 of sleeve 108 and inner sleeve 100, respectively. Gap 114 is created when sleeve 108 and outer sleeve 102 compress spring 96 by pulling up on shoulder 118 with sleeve 100 held in place by shoulder 112.

Once coupling sub 50 is aligned at the proper depth with profile 28, Belleville spring 96 of carriage 94 will pull projecting members 80 of dogs 72 up camming surface 88 of projecting members 82 of mandrel 60 and force dogs 72 into the engaged position as shown in FIGS. 1A–B. Before dogs 72 engage profile 28, key 66 will engage profile 26 so that coupling sub 50 is properly angularly aligned. As coupling sub 50 is engaged within receiver sub 10, key 66 engages muleshoe 30, 32 and guides coupling sub 50 into angular alignment toward profile 26. Once in alignment and at proper depth, coupling sub 50 is configured in accordance with receiver sub 10 so that dogs 72 and key 66 engage their respective profiles 28, 26 at substantially the same time.

Upon engagement with profiles 26, 28, key 66 and dogs 72 snap into place. Once the projecting members 80, 82 are back to back as shown in FIGS. 1A–B, dogs 72 are prevented from retracting out of profile 28 unless a load large enough to compress spring 96 is applied in the upward or downward directions. Since the latching engagement between coupling sub 50 and receiver sub 10 is only intended to locate the desired downhole position, an anchor or a retrievable packer will need to be set to allow the string to withstand any heavy axial loading.

When coupling sub 50 is to be retrieved, the anchor must be retracted and any packer released. Once all anchor devices are retracted, coupling sub 50 can be retrieved by applying a relatively large upward or downward axial load to the drill string. Axial load causes key 66 and dogs 72 to be retracted and disengaged from their respective profiles 26, 28. As described above, tapers 67, 69 compress key 66 into recess 65 of upper section 52 of coupling housing 50. Dogs 72 are displaced axially into windows 83 from their equilibrium positions shown in FIGS. 1A–B when taper 76 or 78 encounters chamfers 38 or 40. When enough axial displacement has occurred, dogs 72 are then able to be retracted closer to mandrel 60 by traveling down camming surface 88 or 90, depending upon the direction traveled.

Figure 6A:
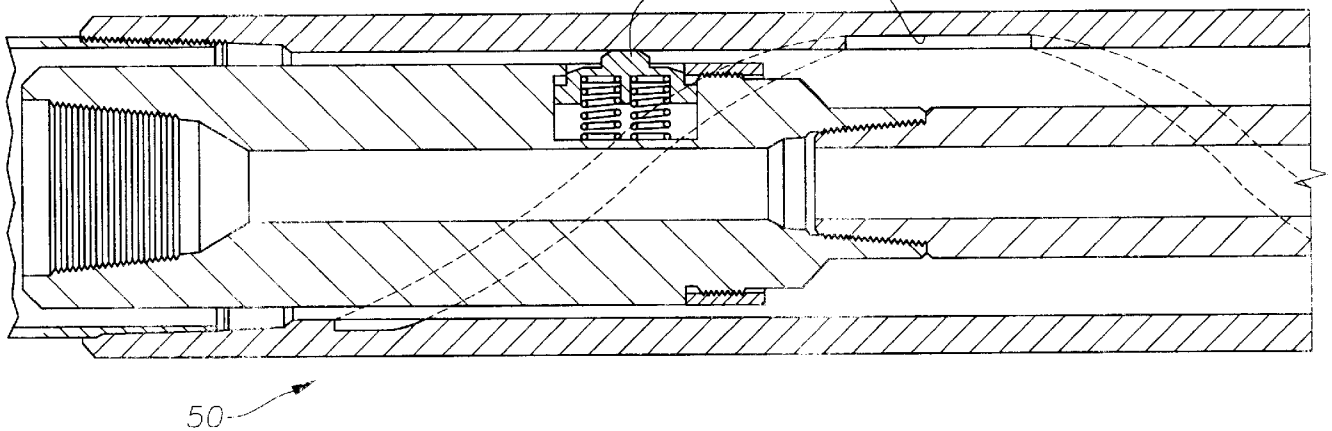
FIGS. 6A–B are a sectioned side view of the coupling sub and corresponding receiver sub of FIGS. 1A–B in the immediately following disengagement.
Figure 6B:
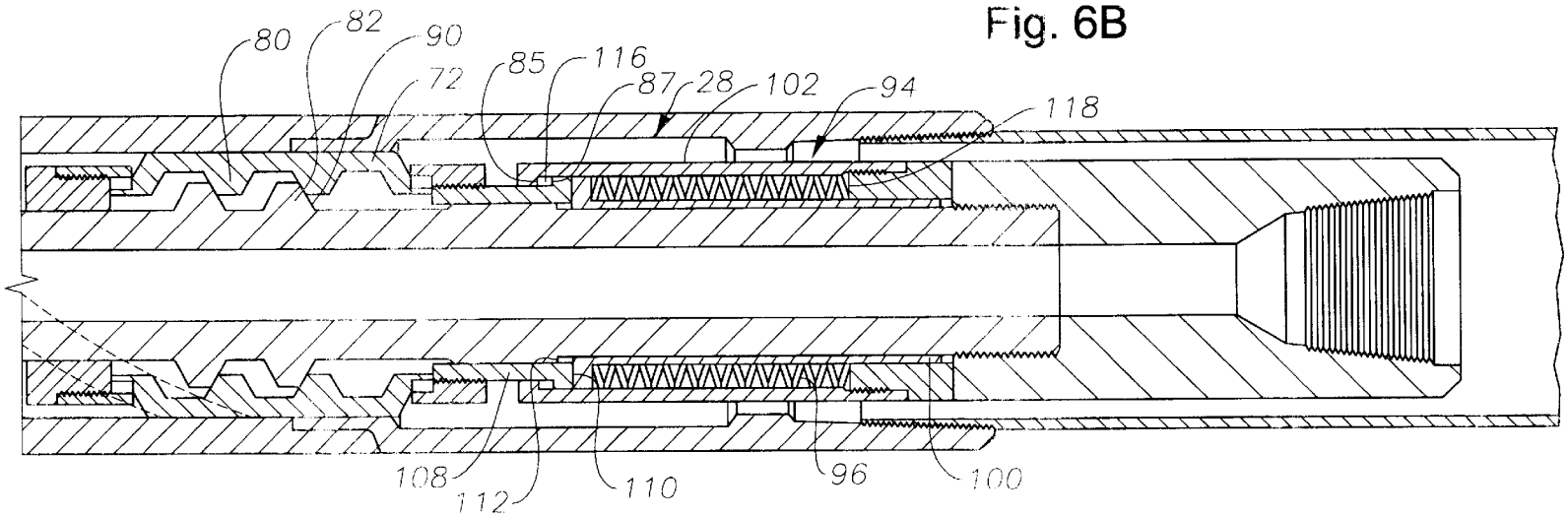

Referring now to FIGS. 6A–B, coupling sub 50 is shown tripping out (upward travel) of the borehole with projecting members 80 on dogs 72 below and abutting camming surfaces 90 of projecting members 82 of mandrel 60. In this position, the upper shoulder 112 of inner sleeve 100 is shouldered against shoulder 110 of sleeve 108. Note that annular shoulders 85, 87 are not in engagement in FIG. 6B but shoulder 112 is in engagement with shoulder 110. A gap exists at 116 between shoulders 85, 87. This gap 116 represents the amount of compression on springs 96 to maintain dogs 72 in the position shown in FIGS. 6A and 6B. Dogs 72 compress spring 96 by pushing sleeve 108 downward.

Figure 7A:
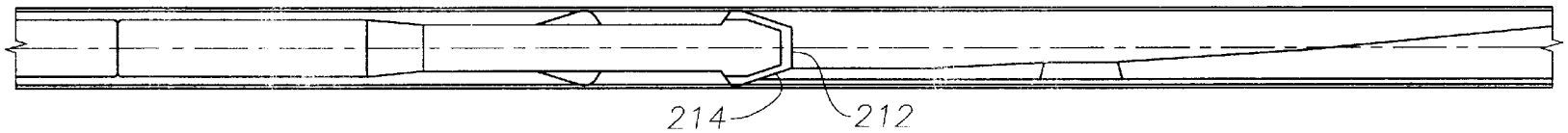
FIGS. 7A–C are a partially sectioned view of the coupling sub assembly of FIGS. 1A–B in a running position.
Figure 7B:
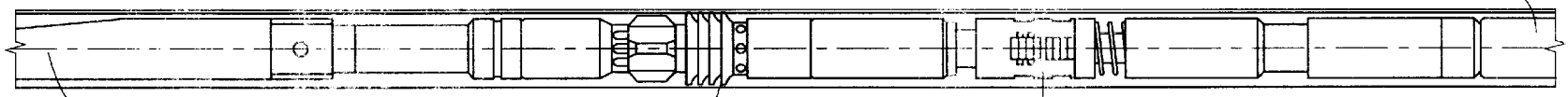
Figure 7C:
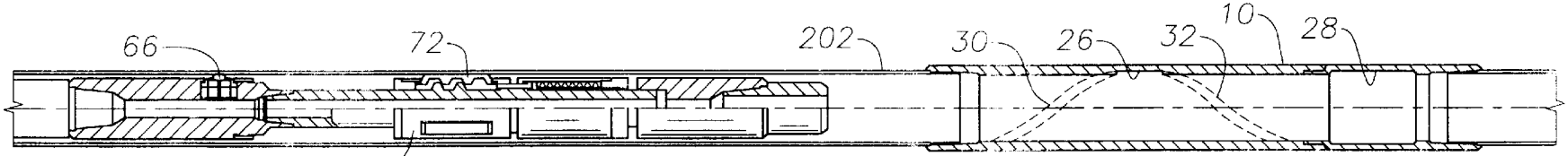

Referring now to FIGS. 7A–11C in series, there is shown an example of the use of orientation and locator system 11 for drilling a side-tracked hole 224 using a one-trip milling system in accordance with a preferred embodiment of the present invention. Referring initially to FIGS. 7A–C, one-trip milling tool string 200 is shown as it is run through a string of casing 202. Tool string 200 includes coupling sub 50, a spline sub 204, a releasable anchor 206, a debris barrier 208, a whipstock 210, and a window mill 212 attached to a whipstock 210 at 214. Tool string 200 is engaged within casing 202 until coupling sub 50 latches and engages with receiver sub 10 disposed in casing string 202 as described above. Key 66 engages the muleshoe 30 and orients the coupling sub 50 and related tool string 200. Coupling sub 50 is then latched within receiver sub 10 and anchor 206 is set.

Figure 8A:
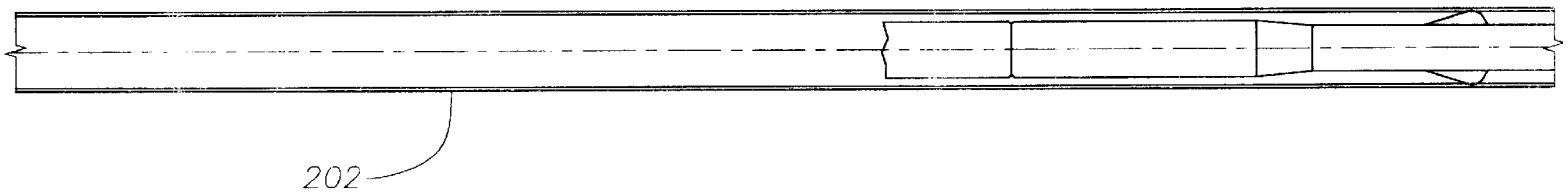
FIGS. 8A–C are a schematic representation of the coupling sub of FIGS. 1A–B and an attached whipstock prior to engagement with a receiver sub.
Figure 8B:
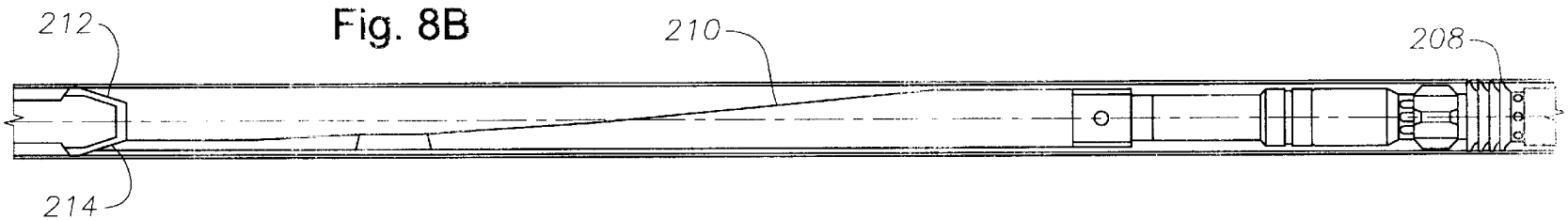
Figure 8C:
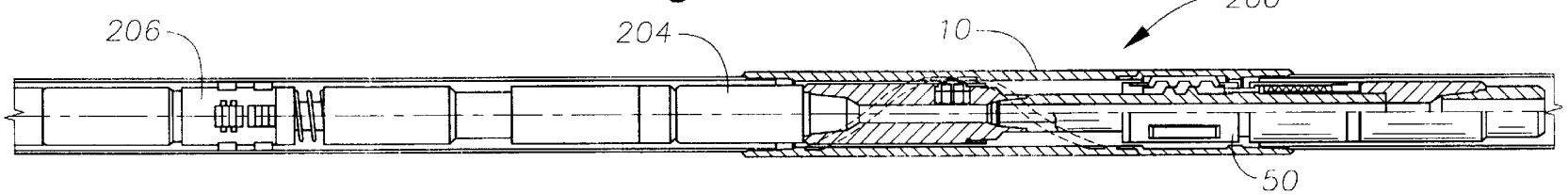

Referring now to FIGS. 8A–C, tool string 200 is shown with coupling sub 50 oriented, engaged and latched within receiver sub 10 of casing string 202. Once engaged, anchor 206 is set. The setting of anchor 206 ensures that any axial forces associated with the milling or any other operations does not displace sub 50 from its oriented position within sub 10. Debris barrier 208 prevents any cuttings or other objects from reaching coupling sub 50 and receiver sub 10 while the milling and drilling operations are being performed. In this position, whipstock 210 is oriented such that window mill 212 will cut a window in casing 202 in the direction orthogonal to the inclined face of whipstock 210. To set the orientation, operators adjust the azimuth of spline sub 204 prior to deployment. Spline sub 204 is thereby set so that whipstock 210 will be in the proper orientation for the desired window when coupling sub 50 engages receiver sub 10.

Figure 9A:
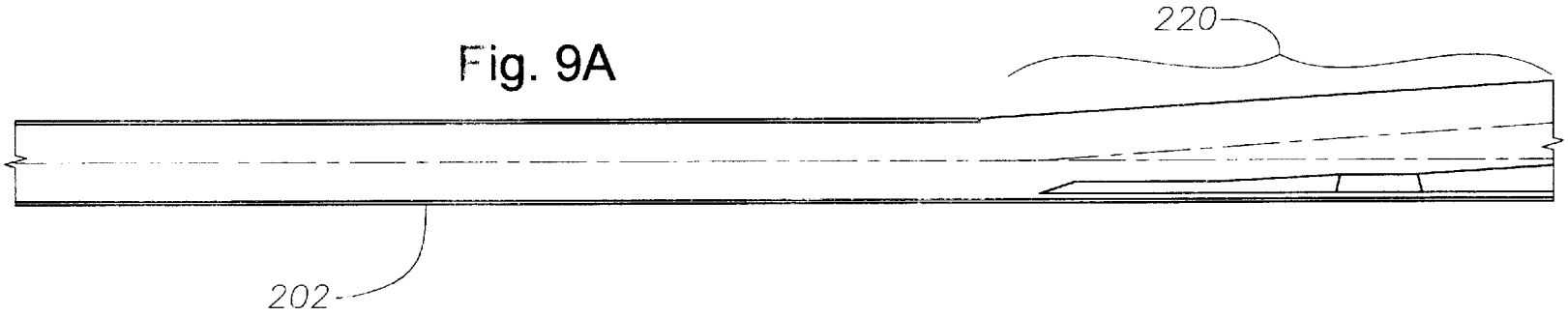
FIGS. 9A–C are a schematic representation of the coupling sub of FIGS. 1A–B and an attached whipstock in engagement with a receiver sub.
Figure 9B:
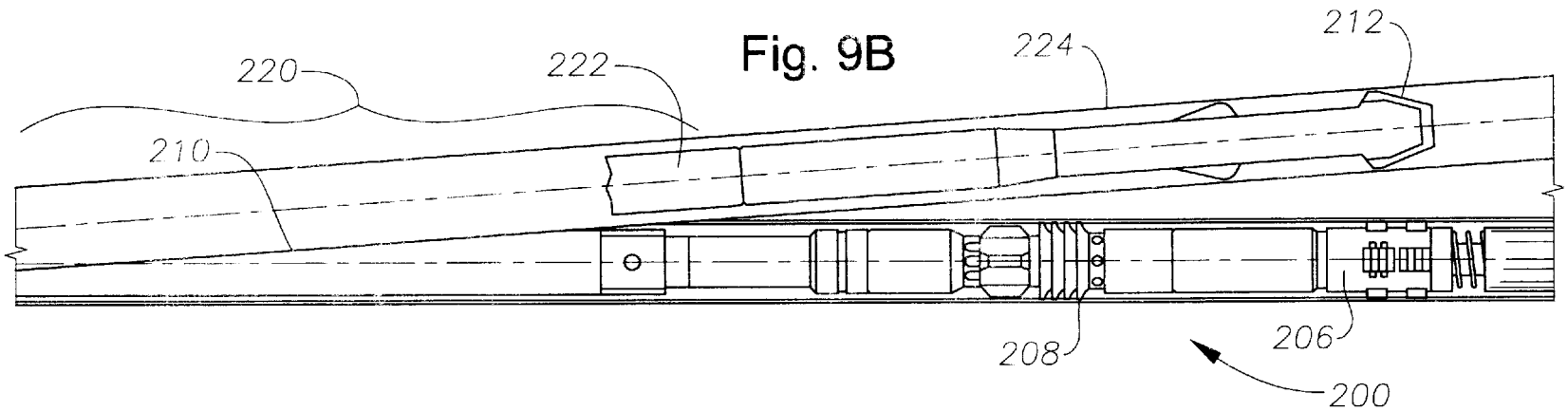
Figure 9C:
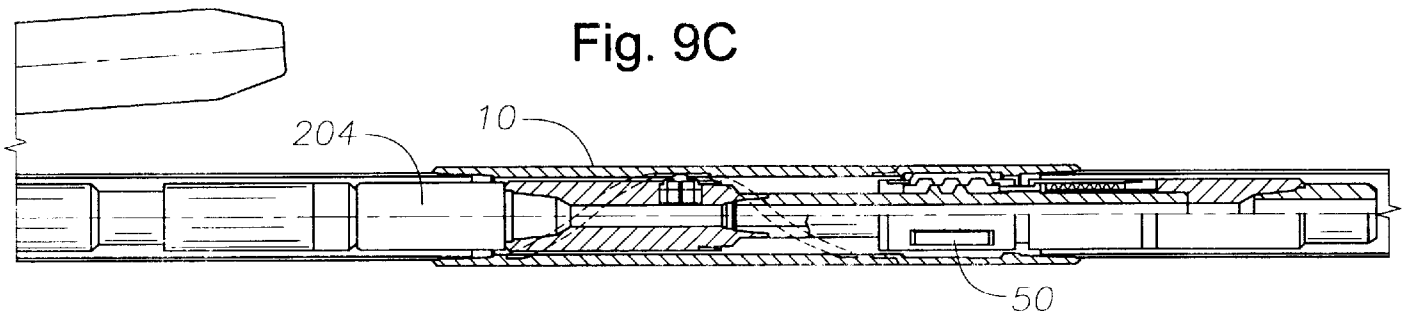

Referring now to FIGS. 9A–C, window mill 212 is detached from whipstock 210 at 214 and is used to cut a window 220 into casing 202 guided by the inclined surface of whipstock 210. Window mill 212 is rotated and axially loaded by a drillstring from the surface and cuts a rat hole 224 as it progresses along whipstock 210. With window 220 cut, the mill 212 and drillstring 222 are retrieved from the side-tracked bore 224 and cased 202 boreholes.

Figures 10A, 10B, 10C:
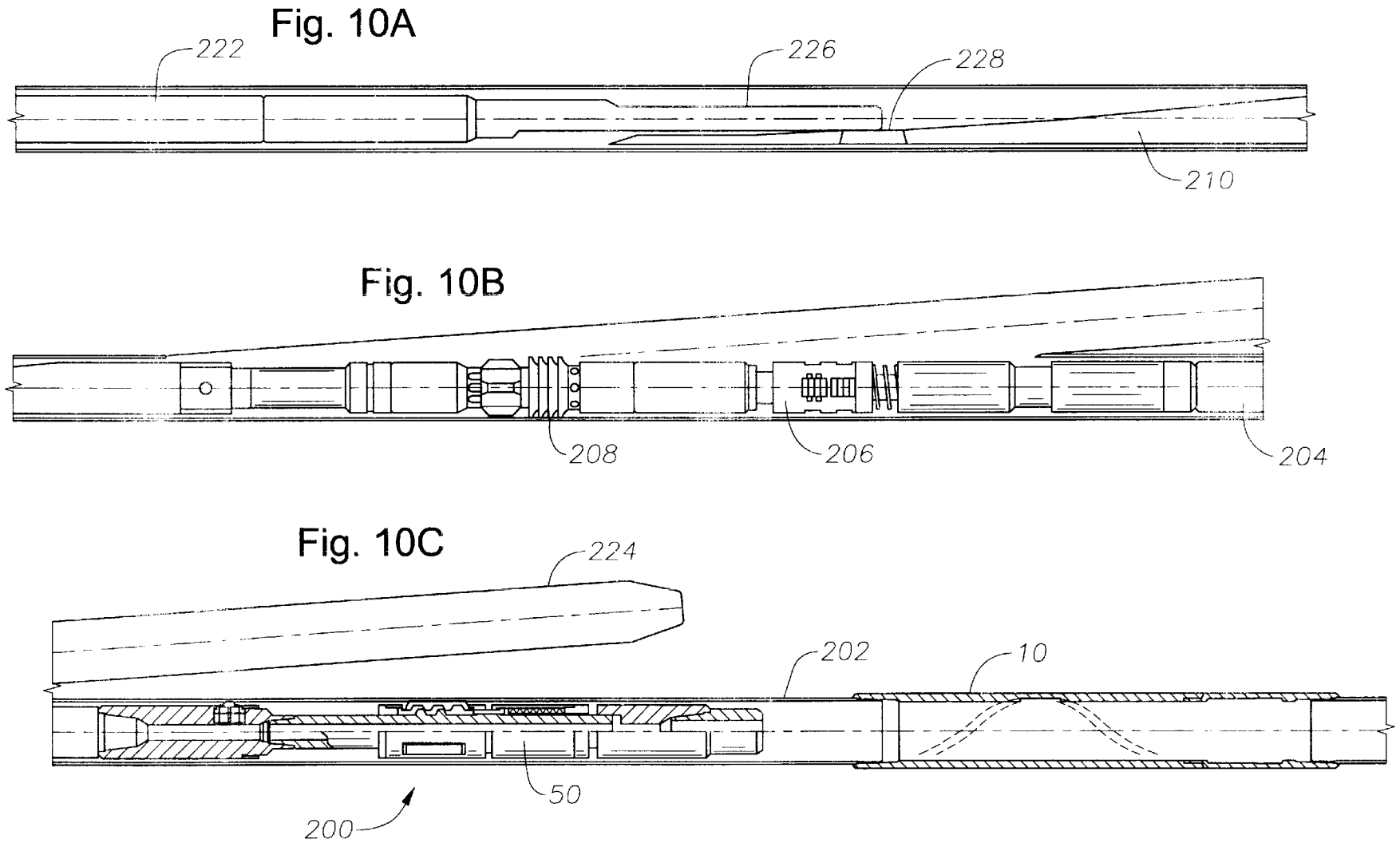
FIGS. 10A–C are a schematic representation of the coupling sub of FIGS. 1A–B and an attached whipstock in engagement with a receiver sub during an window milling operation.

Referring now to FIGS. 10A–C, a retrieval tool 226 is deployed on the drillstring 222 and is attached to whipstock 210 at 228. With retrieval tool 226 attached, anchor 206 is retracted and a large upward load is applied to drillstring 222 to disengage coupling sub 50 from receiver sub 10 as described above. With coupling sub 50 disengaged from receiver sub 10, drillstring 222 and tool string 200 are retrieved from borehole 202 so that sidetracking equipment can be deployed.

Figure 11A:
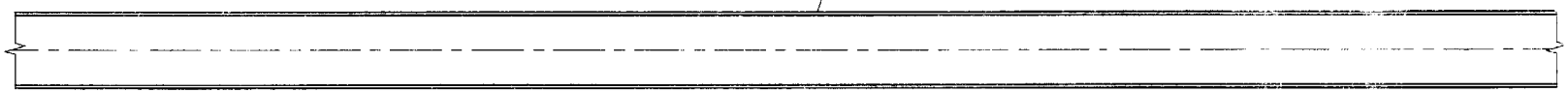
FIGS. 11A–C are a schematic representation of the coupling sub of FIGS. 1A–B and an attached whipstock during to following retrieval from a receiver sub.
Figure 11B:
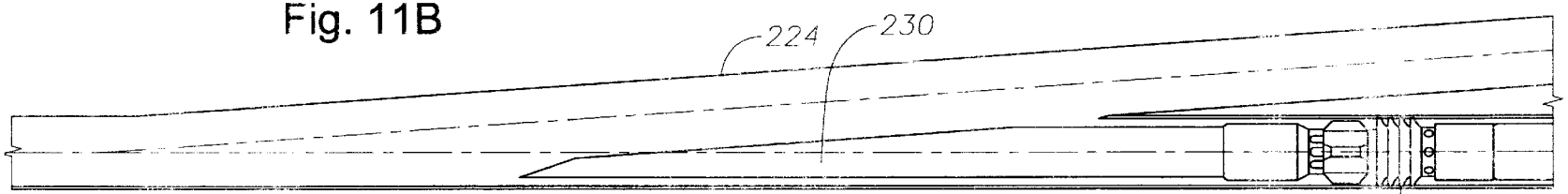
Figure 11C:
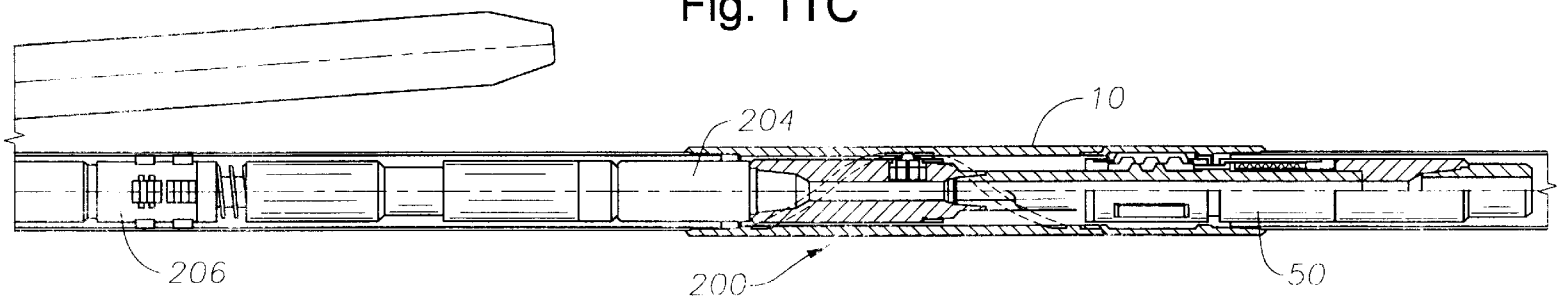

Referring finally to FIGS. 11A–C, tool string 200 is again shown with coupling sub 50 engaged and latched within receiver sub 10 of casing string 202. With tool string 200 installed by a drill string (not shown), anchor 206 is again set to prevent the tool string from deviating from its engaged position. Instead of the whipstock 210 of FIGS. 7A–10C, a deflector 230 is now shown atop toolstring 200 and aligned by spline sub 204. Deflector 230 acts to deflect drill string components (not shown) into newly milled sidetracked borehole 224 created by the window mill and whipstock operation described above. With deflector 230 in place, side tracked borehole 224 can be drilled into the surrounding formation.

A primary benefit of the orientation and locator system 11 presented herein is the ability to accurately and repeatably locate a position by depth and azimuth within a cased borehole. Furthermore, the coupling system of the present invention has the added advantage over those currently available in that the receiver sub 10 does not obstruct the borehole. A coupling sub 50, or any other tool, is able to pass through receiver sub 10 to deeper depths in the casing string 16 with little or no added assistance force. As such, the existence of receiver sub 10 in a string of casing will not impair further drilling, production, or workover operations in the borehole in which it is installed. Other systems currently available require that smaller gauge tools be used if a locator is to be bypassed. Operations can be even more severely limited if several couplers in series, each with a successively smaller pass through gauge must be bypassed.

The orientation and locator system is particularly useful in a new well where the receiver sub is run in with the casing string. Because the orientation and locator system presented herein is substantially non-obstructive, more traditional (and obstructive) couplers may be installed at later dates to accommodate any changes in well design that may be required. Using these types of systems together, although not able to eliminate bore obstructions, should dramatically reduce their numbers.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What I claim is:

1. An assembly for orienting and locating a well operation in a borehole, comprising:

a casing string installed in the borehole and including a first wall with a first thickness;

said casing string including a tubular member with a second wall;

a depth profile and an orientation profile each milled into but not through said second wall at a known location in the borehole; and a work string having a locator engageable with said profiles as said work string is lowered through a bore in the casing string;

said second wall having a second thickness at said profiles at least equal to said first thickness of said first wall.

2. The assembly of claim 1 wherein said depth profile does not extend into said bore in said casing string.

3. The assembly of claim 1 wherein said depth profile is an annular groove.

4. The assembly of claim 1 wherein said orientation profile includes an orientation surface and said work string includes an orientation member engageable with said orientation surface as said work string passes through said bore in the casing string.

5. The assembly of claim 4 wherein said orientation surface does not extend into said bore in said casing string.

6. The assembly of claim 4 wherein said orientation profile further includes a slot and said orientation surface includes a cam surface directing said orientation member into said slot.

7. The assembly of claim 6 wherein said orientation member is a key adapted to engage said cam surface to rotate said work string until said key rests in said slot.

8. The assembly of claim 6 wherein said orientation member is biased outwardly on a sub and disposed in said work string.

9. The assembly of claim 6 wherein said orientation surface includes a first cam surface on one side of said slot and a second cam surface on another side of said slot, said cam surfaces directing said orientation member into said slot.

10. The assembly of claim 1 wherein said locator includes a contracted position and an expanded position.

11. The assembly of claim 10 wherein said locator is disposed on a sub in the work string, said sub and locator having co-acting portions which cam said locator between said contracted and expanded positions and which lock said locator in said expanded position.

12. The assembly of claim 10 further including a spring member biasing said locator towards said expanded position.

13. The assembly of claim 12 wherein said locator is housed in a sleeve around said sub and said spring member includes a spring housed between a inner member and an outer member, one of said inner and outer members being attached to said sleeve.

14. The assembly of claim 13 wherein said sleeve moves one of said inner or outer members with respect to the other of said inner or outer members in a first direction and moves said other of inner or outer members with respect to said one of inner or outer members in a second direction.

15. An assembly to be deployed into a wellbore, comprising:

at least one receiver sub disposed in a casing string;

said receiver sub having a depth profile configured to locate an axial position and an azimuth profile to locate an angular position within the wellbore;

a coupling sub attached to a well tool and adapted to be passed through the casing string;

said coupling sub having a plurality of dogs adapted to engage said depth profile and at least one position key adapted to engage said azimuth profile;

said coupling sub positioning the orientation and location of the well tool in the wellbore in response to said dogs and said position key engaging said depth and azimuth profiles.

16. The assembly of claim 15 wherein said dogs and said position key of said coupling sub simultaneously engage said depth profile and said azimuth profile of said receiver sub.

17. The assembly of claim 15 wherein said well tool includes a retractable anchor to prevent displacing said coupling sub from said receiver sub during use of said well tool.

18. The assembly of claim 15 wherein said coupling sub is configured to pass through said receiver sub en route to a second receiver sub in the wellbore.

19. The assembly of claim 15 wherein said depth profile includes tapers to contract said dogs when an axial load is placed upon said coupling sub.

20. The assembly of claim 15 wherein said azimuth profile includes tapers to contract said position key when an axial load is placed upon said coupling sub.

21. The assembly of claim 15 wherein said dogs include tapers to disengage said dogs from said depth profile when an axial load is placed upon said coupling sub.

22. The assembly of claim 15 wherein said position key includes tapers to disengage said position key from said azimuth profile when an axial load is placed upon said coupling sub.

23. The assembly of claim 22 wherein said position key is configured to resist disengagement with said azimuth profile when an angular load is placed upon said coupling sub.

24. The assembly of claim 15 wherein said dogs are biased into engagement within said depth profile by a spring.

25. The assembly of claim 24 wherein said spring is a stack of belleville washers.

26. The assembly of claim 15 wherein said position key is biased into engagement within said azimuth profile.

27. The assembly of claim 15 wherein said well tool further includes a spline sub, said spline sub configurable to adjust the angular position of said well tool.

28. The assembly of claim 15 wherein the minimum inner diameter of said receiver sub is no smaller than the remainder of the casing string.

29. An assembly configured to be installed into a wellbore, comprising:

a casing string having at least one receiver sub, said receiver sub configured to locate axial and angular positions within the wellbore;

said receiver sub having a location profile within the inner diameter of said receiver sub, said location profile configured to locate said axial and angular positions;

a coupling sub to be disposed within the casing string of the wellbore and engaged by said receiver sub;

said coupling sub having at least one alignment key to engage said location profile; and said coupling sub positioning said well tool in a desired location within the wellbore in response to said alignment key engaging said location profile.

30. The assembly of claim 29 wherein said coupling sub is configured to pass through said receiver sub en route to a second receiver sub in the wellbore.

31. An assembly configured to be installed into a wellbore, comprising:

at least one receiver sub disposed in a casing string, said receiver sub configured to locate at least one position within the wellbore;

said position including an axial orientation and an angular orientation;

said receiver sub having a location profile within the inner diameter of said receiver sub, said location profile configured to locate said axial orientation and said angular orientation;

a coupling sub slidably disposed within the casing string, said coupling sub having at least one well tool attached thereon;

said coupling sub having at least one alignment key to engage within said location profile to move said well tool to said position; and said coupling sub is configured to pass through said receiver sub en route to a second position in the casing string.

32. An assembly configured to be installed into a wellbore, comprising:

at least one receiver sub disposed in a casing string, said receiver sub configured to locate at least one position within the wellbore;

said position including an axial orientation and an angular orientation;

said receiver sub having a depth profile and an azimuth profile within the inner diameter of said receiver sub, said depth profile configured to locate said axial orientation and said azimuth profile configured to locate said angular orientation;

a coupling sub slidably disposed within the casing string, said coupling sub having at least one well tool attached thereon;

said coupling sub having a plurality of dogs to engage with said depth profile;

said coupling sub having at least one alignment key to engage within said azimuth profile;

said coupling sub positioning said well tool to said position in response to said dogs engaging said depth profile and said alignment key engaging said azimuth profile; and said coupling sub is configured to pass through said receiver sub en route to a second position in the casing string.

33. The assembly of claim 32 wherein said dogs are configured to engage with said depth profile regardless of the relative direction of travel between said coupling sub and said receiver sub.

34. The assembly of claim 32 wherein said alignment key is configured to engage with said azimuth profile regardless of the relative direction of travel between said coupling sub and said receiver sub.

35. The assembly of claim 32 wherein the inner diameter of said receiver sub is no less than the remainder of the casing string.

36. The assembly of claim 32 wherein said depth and azimuth profiles of said receiver sub do not obstruct the passage of materials through the casing string.

37. An assembly to be deployed into a wellbore, comprising:

at least one receiver sub disposed in a casing string, said receiver sub configured to locate an axial position within the wellbore;

said receiver sub having a depth profile within the inner diameter of said receiver sub, said depth profile configured to locate said axial position;

a coupling sub to be removably disposed within the casing string and engaged by said receiver sub, said coupling sub having at least one well tool attached thereon;

said coupling sub having a plurality of dogs that are not hydraulically loaded to engage said depth profile; and said coupling sub positioning said well tool in the wellbore when said dogs engage said depth profile.

38. An assembly to be deployed into a wellbore, comprising:

at least one receiver sub disposed in a casing string, said receiver sub configured to locate an angular position within the wellbore;

said receiver sub having an azimuth profile within the inner diameter of said receiver sub, said azimuth profile configured to locate said angular position;

a coupling sub to be removably disposed within the casing string and engaged by said receiver sub, said coupling sub having at least one well tool attached thereon;

said coupling sub having at least one position key to engage said azimuth profile; and said coupling sub positioning said well tool in the wellbore in response to said position key engaging said azimuth profile.

39. A method for conducting a well operation at a predetermined location and orientation within a borehole, comprising:

installing a string of casing having a location profile and an azimuth profile;

passing a locator attached to a well tool through a bore of the casing string;

engaging the locator in the location profile;

engaging the locator in the azimuth profile without rotating the locator; and locating the attached well tool at the predetermined location and orientation within the borehole.

40. The method of claim 39 further including orienting the locator and well tool prior to the locator engaging the location profile.

41. An assembly for orienting and locating a well operation in a borehole, comprising:

a casing string installed in the borehole and including a profile at a known location in the borehole and an orientation surface adjacent said profile; and a work string having a locator engageable with said profile to locate said well operation and an orientation member engageable with said orientation surface to orient said well operation as said work string is moved axially through a bore in the casing string.

42. The assembly of claim 41 wherein said orientation surface does not extend into said bore in said casing string.

43. The assembly of claim 41 wherein said orientation surface includes at least one cam surface that engages said orientation member to cause said work string to rotate until said orientation member rests within a slot in said casing string.

44. The assembly of claim 43 wherein said orientation surface includes a first cam surface on one side of said slot and a second cam surface on another side of said slot, said first cam surface engaging said orientation member when said work string is moved downwardly through said bore in the casing string, and said second cam surface engaging said orientation member when said work string is moved upwardly through said bore in the casing string.

* * * * *

UNITED STATES PATENT AND TRADEMARK OFFICE
Certificate

Patent No. 6,568,480 B2 Patented: May 27, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Charles H. Dewey, Houston, TX; and John E. Campbell, Houston, TX.

Signed and Sealed this Thirtieth Day of March 2004.

DAVID J. BAGNELL
*Supervisory Patent Examiner*
Art Unit 3672